United States Patent [19]

Ball et al.

[11] Patent Number: 4,978,056

[45] Date of Patent: Dec. 18, 1990

[54] PACKAGING

[76] Inventors: Martin F. Ball, Cottage, Walnut Tree Grove; Ian M. Vokins, 18 Linden, Crescent, Grove, both of Wantage, Oxfordshire, United Kingdom

[21] Appl. No.: 277,155

[22] PCT Filed: Nov. 23, 1988

[86] PCT No.: PCT/GB87/00925

§ 371 Date: Nov. 23, 1988

§ 102(c) Date: Nov. 23, 1988

[87] PCT Pub. No.: WO88/05011

PCT Pub. Date: Jul. 14, 1988

[30] Foreign Application Priority Data

Dec. 31, 1986 [GB] United Kingdom ..... 8631049
Dec. 29, 1987 [ZA] South Africa ..... 87/9738

[51] Int. Cl.[5] ..... B65D 51/00; B65D 5/70

[52] U.S. Cl. ..... 229/123.2; 53/412; 53/420; 53/477; 156/69; 156/224; 220/258; 220/359; 264/292; 264/154; 264/372; 425/297; 428/461; 493/85; 493/102

[58] Field of Search ..... 229/123.1, 123.2, 123.3, 229/125.14, 3.5 MF; 220/258, 259, 359; 264/154, 156, 160, 292, 322; 493/102, 103, 105, 109, 56, 85; 53/412, 420, 471, 282, 477, 488, 489, 133, 307; 156/69, 221, 224, 272.4, 273.9; 425/305.1, 297, 398; 428/461, 463, 913

[56] References Cited

U.S. PATENT DOCUMENTS

| | | | |
|---|---|---|---|
| 2,719,663 | 10/1955 | Meyer-Jagenberg | 229/123.3 |
| 2,743,859 | 5/1956 | Negoro | 53/39 |
| 3,890,448 | 6/1975 | Ito | 229/3.5 MF |
| 3,951,331 | 4/1976 | Smith et al. | 229/123.2 |
| 4,040,561 | 8/1977 | Philippon | 220/259 |
| 4,141,463 | 2/1979 | Smith | 229/125.25 |
| 4,171,084 | 10/1979 | Smith | 229/5.7 |
| 4,261,502 | 4/1981 | Ohmori | 229/1.5 B |
| 4,268,336 | 5/1981 | Piltz et al. | 229/123.2 |
| 4,341,340 | 7/1982 | Lisiecki | 229/132 |
| 4,433,808 | 2/1984 | Gordon et al. | 229/123.2 |
| 4,452,842 | 6/1984 | Borges et al. | 220/359 |
| 4,533,063 | 8/1985 | Buchner et al. | 229/123.2 |
| 4,605,232 | 8/1986 | Hundstad | 428/461 |
| 4,632,298 | 12/1986 | Schellenberg | 229/5.5 |
| 4,692,132 | 9/1987 | Ikushima et al. | 492/109 |
| 4,710,426 | 12/1987 | Stephens | 428/463 |

FOREIGN PATENT DOCUMENTS

| | | | |
|---|---|---|---|
| 136227 | 8/1984 | Japan | 156/224 |
| 4031 | 1/1985 | Japan | 156/69 |

*Primary Examiner*—Gary E. Elkins
*Attorney, Agent, or Firm*—Brian J. Coyne

[57] ABSTRACT

In a system of packaging of foodstuffs in containers of rectangular horizontal section, each open-topped container is sterilized, filled, and closed with a sterilized closure. The closure is of a laminate including a thermoplastics layer of sufficient thickness to fill an internal discontinuity of the container mouth during heat-sealing of the closure to the container. In making the closure, a portion of laminate is partially severed to form a flap and the laminate is clamped around the flap and drawn to form a shallow dish, to the inside of the base of which is heat-sealed a diaphragm including a pull tab. The thermoplastics layer is on a reflective metal layer and incorporates infrared-absorbing particles and infrared-reflective particles.

27 Claims, 13 Drawing Sheets

PACKAGING

Figure 1:
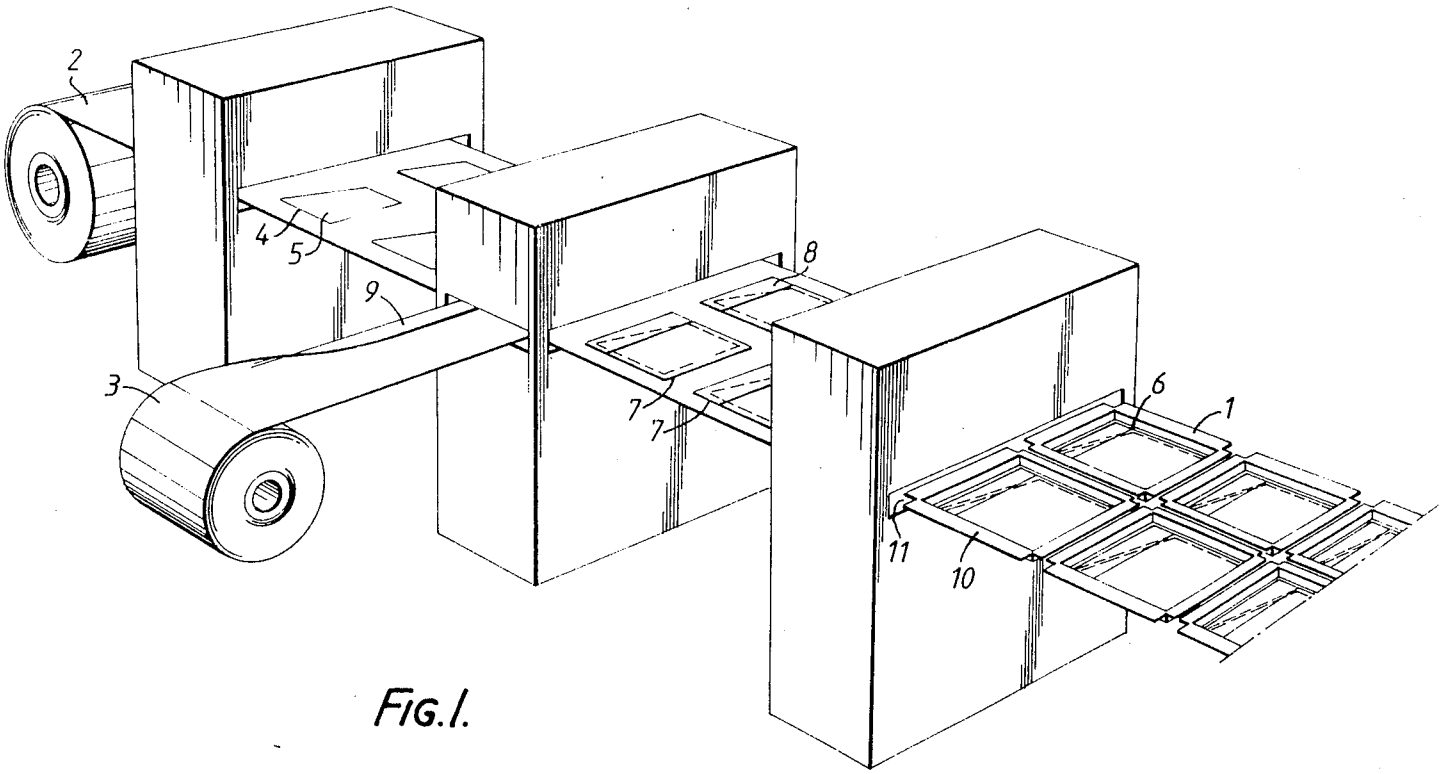

This invention relates to the packaging of various substances, especially foodstuffs, in closed containers.

DE-A-2344620 discloses a system for producing deep-drawn recesses in packaging material which, after filling, are sealingly covered with a continuous metallic lidding foil, and subsequently divided into individual containers or groups of containers. The packaging material comprises a base strip of thermoplastics and an upper strip of metal foil which are fed in parallel to a deep-drawing device, the thermoplastics strip being fed thereto through a preheating device. The deep-drawing device consists of a transverse row of female dies in the form of circular cylindrical cups reciprocable perpendicularly to the planes of the strips, a transverse row of circular intermediate rings, and a transverse row of circular thrust rings encircling respective cylindrical male dies and encircled by knives for severing circular discs of metal foil from the strip. The male dies press the metal foil discs into the female dies and simultaneously deep-draw circular parts of the thermoplastics strip. The profiled plastics strip so formed and containing transverse rows of recesses receiving the metal foil dishes is then advanced to a device for flattening over outwards the rim of each metal foil dish to form a horizontal flange thereon, the dishes are filled with the substance to be packaged and then the metallic lidding foil is applied over the profiled plastics strip with its metal foil dishes, and the lidding foil is heat-sealed to the flanges.

The packaging containers so produced have a number of disadvantages, for example the metallic lidding foil cannot be easily opened, for example cannot be simply peeled off, but has to be pierced, which can be a messy procedure, with the contents being spilled over the container and elsewhere. Secondly, unless the metallic lidding foil is relatively thick, it is easily split.

DE-A-2640591 discloses a system for forming dish-shaped lightweight packaging containers, each having a projecting edge flange and a plane base, from a workpiece of thin synthetic material and/or aluminum foil. The planar workpiece is held clamped between two annular rims, and a fluid under pressure acts upon one side of the workpiece. The central area of the consequently arching workpiece so formed is flattened by a supporting surface, which may be a piston head.

U.S. 2,615,201; U.S. 4,048,781 and U.S. 3,964,237 described similar systems in which sheet material to be deep-drawn is clamped between two circular rings of a deep-drawing device.

U.S. 4,141,195 discloses a method and apparatus for forming a heat-shrinkable secondary closure for a container, wherein filled, lidded containers are delivered to a secondary closure formation and application station, where a band of heat-shrinkable thermoplastics adhesive tape is wrapped around each container such that the tacky side of the tape faces the container, with tape overlapping the seam formed between the periphery of the lid and the sidewall of the container. The tape band is severed from the tape applied during wrapping, and heater means located adjacent the container shrinks the tape into compressive engagement with the periphery of the lid and the sidewall of the container as the tape is wrapped thereabout. Integral gripping tabs are formed at spaced positions in the tape prior to wrapping of the tape band and shrinking thereof, and once the band is shrunk into tight adhesive engagement with the container, the tab is positioned near an outer overlapping end of the band to provide convenient means for removal of the tape from the container. The end of the tape beyond the gripping tab is adhesively secured to an underlying portion of the band to retain the gripping tab in place.

With such closed container, opening of the container is normally accomplished by seizing the tab and pulling the same to unwind the tape completely from the container and then by removal of the lid. This can have the disadvantage that first the tape and thin the lid can be thrown away separately from the container, and so produce more litter.

EP-A-0057436 discloses a cylindrical container with a re-closing lid and a closing membrane which is disposed between the container and the lid and which is sealed to the wall of the container. The membrane is of a disc form with a diametral double fold. The membrane is provided with arcuate incisions at the respective ends of the fold. To open the container, the re-closing lid is removed and the double fold is gripped between thumb and forefinger and pulled to tear the majority of the membrane away from the container.

In that arrangement, the re-closing lid and the torn-off membrane can constitute additional litter.

CH-A-655480 discloses a dish-form container provided with a lid consisting of sheet material and having edges arranged to be bent over to beneath a peripheral flange of the container. The sheet-material lid is formed with a double fold therein and is formed with diametrically opposite pull tabs. With his two hands grasping the pull tabs, a consumer can pull the tabs away from each other to open out the double fold to disconnect the bent-over edges of the lid from one end of the container and can then pull the pull tab at that one end away from the container and towards the other pull tab to cause the lid to slide off the container.

Again, the lid can constitute extra litter.

Other such arrangements are disclosed in U.S. 3,381,884 and GB491,950.

GB1480970 discloses a lidded container, wherein the container is cup-like and is formed of any suitable natural or synthetic material including paper, metal, or synthetic plastics. Such plastics container may comprise polyurethane, polyvinyl chloride or polystyrene. A rectangular foil lid is bonded to a top peripheral flange of the container. The lid may be of any suitable material, depending upon the material used for the container and the type of substance to be placed in the container. In a preferred form, the lid comprises aluminium foil. Any suitable adhesive is used for bonding the lid to the flange, and will depend upon the materials used for the container and for the lid. Where the container is formed of synthetic thermoplastics, and the lid is formed of aluminum a suitable thermoplastic adhesive such as polyvinyl acetate, polyvinyl alcohol, acrylic or polyamide is applied as the coating on the surface of the lid which engages the flange. The lid is heated for softening the adhesive prior to positioning of the lid on the container. The softened adhesive on the lid will then bond to the flange.

U.S. 3,557,520 discloses a device for heat-sealing a bottle and valve assembly, where the valve assembly is pre-heated before being fixed to the bottle.

U.S. 4,261,502 discloses a closure system for a liquid container comprised of a container body having at least one open end. The container body is provided on its inner surface with a coating of heat sealable thermoplastics. The container also comprises one or more end sealing pieces closing off the open end (s) of the container body. The or each end sealing piece has a circumferential flange which has on an outer surface thereof a coating of heat sealable thermoplastics the flange being joined to the rest of the end sealing piece by way of a flexural edge. The circumferential flange of the end sealing piece and the rim of the open end of the container body are heat-sealed together The coating of thermoplastics on the flange may extend over the whole of the inside surface of the end sealing piece. The container body and the or each end sealing piece may comprise aluminium coated with the thermoplastics.

The container body may consist of paper coated on both sides with polyethylene. The end sealing piece may consist of paper, cellophane or aluminium foil. The heat sealable thermoplastics coated on the end sealing piece is preferably polyethylene, polypropylene, vinyl chloride or vinylidene chloride. It may for example consist of a polyethylene film of a thickness of from 40 to 150 microns on paper, cellophane or aluminum foil. Alternatively, the end sealing piece may be a laminate of two kinds of plastics, such as polyethylene and polypropylene, which have different fusing points.

U.S. 3,191,359 discloses a machine for continuous filling and sealing of cans sealed ends. The cans are non-metallic, preferably fibrous, for example paper or paperboard and are closed with metallic closures having portions insertable into the can body and bearing a heat-activable adhesive which is heated to form a can-to-closure bond. Infrared heating elements, such as bulbs, positioned above an assembled can heat the heat-activatable adhesive applied to the flanges of the closures. Since the closure is metallic and therefore a good conductor of heat, the heat is conveyed readily and directed to the adhesive.

However, this system would not be suitable in circumstances in which the outside surface of the metallic closure is covered with a layer or coating, for example an attractive lacquer or printing, which is liable to be damaged by infrared heating or which would significantly delay the transfer of heat to the adhesive.

CH369064 discloses a sealed container closed by an inner sheet received within the mouth of the container and by an outer sheet which is adhered to the inner sheet and to the rim of the container. Pulling of the outer sheet removes the inner sheet at the same time.

However, in this arrangement two sheets can be removed together completely from the container and can thus constitute additional litter.

According to a first aspect of the present invention, there is provided a method comprising forming a dish-like article from thin sheet material, said forming comprising clamping the sheet material between two ring means and drawing the encircled sheet material to one side of the general plane of the sheet material, characterised in that said method includes, prior to said drawing, partially severing a portion of said sheet material from the remainder thereof along substantially a line of severance in the form of an open loop, said ring means encircling and being spaced outwardly from said line of severance, and said drawing serving to displace said line of severance to said one side.

Although the clamping may take place before, during, or after, the partial severing, it advantageously takes place thereafter but immediately prior to the drawing.

According to a second aspect of the present invention, there is provided a dish-like article which is of sheet material, characterised in that the base of the article includes a portion partially severed from the remainder of the article along substantially a line of severance in the form of an open loop.

This method and article have the advantage that the line of severance facilitates drawing of the sheet material without consequent splitting of the material which is especially difficult when sharp-cornered, for example sharp-cornered rectangular, shapes are being drawn.

According to a third aspect of the present invention, there is provided a container and a closure therefor, the container having a mouth the edge of which has internally a discontinuity, and the closure comprising a laminate sheet material including an innermost layer of a thermoplastic substance arranged to come face-to-face with said discontinuity, characterised in that said thermoplastic substance is of sufficient thickness to fill said discontinuity during heat-sealing of said closure to said container.

This arrangement minimizes any risk of leakage from or into the sealed container by way of the discontinuity.

The discontinuity can be a groove bounded by the cut longitudinal edge of a seam panel at a corner of the container, or can be a groove between ribs of the edge of the container mouth which ribs extend transversely of the mouth edge.

According to a fourth aspect of the present invention, there is provided a laminate comprising a relatively reflective layer and, on the latter, an external layer comprised of a relatively transparent thermoplastic substance which is to be heated by infrared radiation, characterised in that said laminate incorporates material which is relatively absorptive of said infrared radiation.

The inclusion of the infrared absorptive material promotes heating of the relatively transparent thermoplastic, as opposed to reflection back of the infrared radiation by the reflective layer.

The thermoplastic layer preferably incorporates an additional material which is relatively reflective of the infrared radiation. This promotes scatter of the radiation and thus greater absorption thereof.

According to a fifth aspect of the present invention, there is provided a pack part comprising a surround, a flap obdurating an opening encircled by said surround, said flap being directly attached along one side thereof to said surround, characterised in that a diaphragm is attached face-to-face to said flap and also sealingly attached around its periphery to said surround, the arrangement being such that pulling of said diaphragm commencing from that side of said surround opposite to said one side progressively detaches said diaphragm from said surround and pulls said flap progressively open until said flap is substantially fully open.

This arrangement reduces litter, because a consumer is more likely to leave the diaphragm attached to the flap after consumption of the contents.

According to a sixth aspect of the present invention, there is provided a method of applying a closure to a container, comprising providing a closure comprised of a thermoplastic first layer applied to a second layer of a material of a higher melting point than the material of the first layer, providing a container with a mouth rim portion of a thermoplastic material of a melting point lower than that of said second layer, heating said first layer from that side thereof opposite to said second layer to a temperature above the melting point of said first layer and the melting point of said mouth rim portion, and applying said closure to said container, with said first layer being applied to said mouth rim portion and melting the same to produce a bond between said first layer and said mouth rim portion upon cooling thereof.

This method serves to produce a strong and reliable seal at the mouth rim portion between the closure and the container.

It is particularly advantageous if the first layer and the mouth rim portion are of the same thermoplastic material as each other, because then a particularly intimate bond is achievable.

According to a seventh aspect of the present invention, there is provided a laminate comprising a thermoplastic first layer applied to a second layer of material of a higher melting point than the material of the first layer, characterised in that the thickness of the first layer is of the order of 200 microns and roughly equal to the thickness of the second layer.

According to an eighth aspect of the present invention, there is provided apparatus comprising means for forming a dish-like article from thin sheet material, said means for forming comprising clamping means including two ring means for clamping the sheet material between them, and means for drawing the sheet material encircled by said ring means to one side of the general plane of the sheet material, characterised in that said means for forming includes means for partially severing a portion of said sheet material from the remainder thereof along substantially a line of severance in the form of an open loop, prior to said drawing.

According to a ninth aspect of the present invention, there is provided apparatus for applying a closure comprised of a thermoplastic first layer applied to a second layer of a material of a higher melting point than the material of the first layer, to a container with a mouth rim portion of a thermoplastic material of a melting point lower than that of said second layer, comprising means for heating said first layer from that side thereof opposite to said second layer to a temperature above the melting point of said first layer and the melting point of said mouth rim portion, and means for applying said closure to said container, with said first layer being applied to said mouth rim portion for melting the same to produce a bond between said first layer and said mouth rim portion upon cooling thereof.

Figure 2:
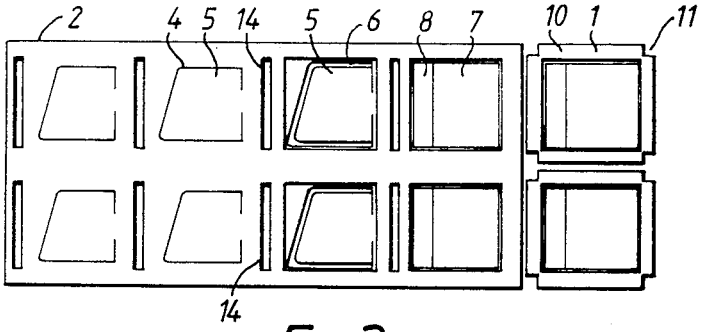
Figure 3:
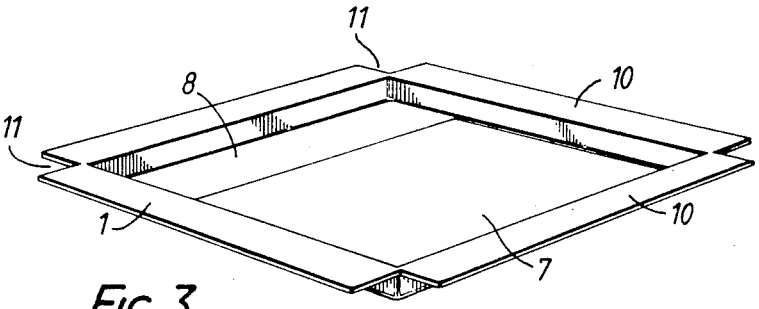
Figure 4:
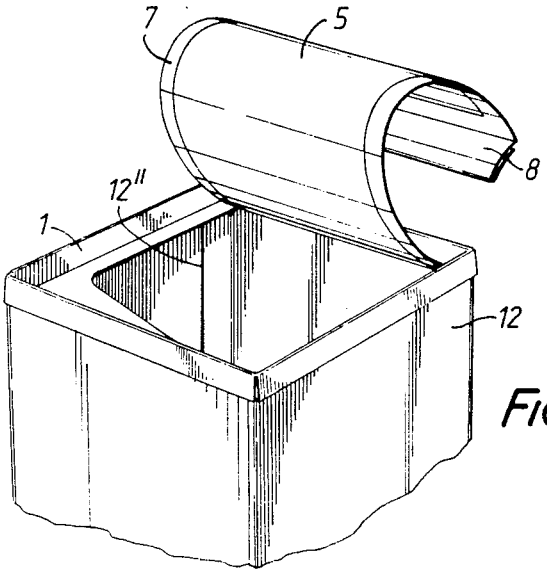
Figure 5:
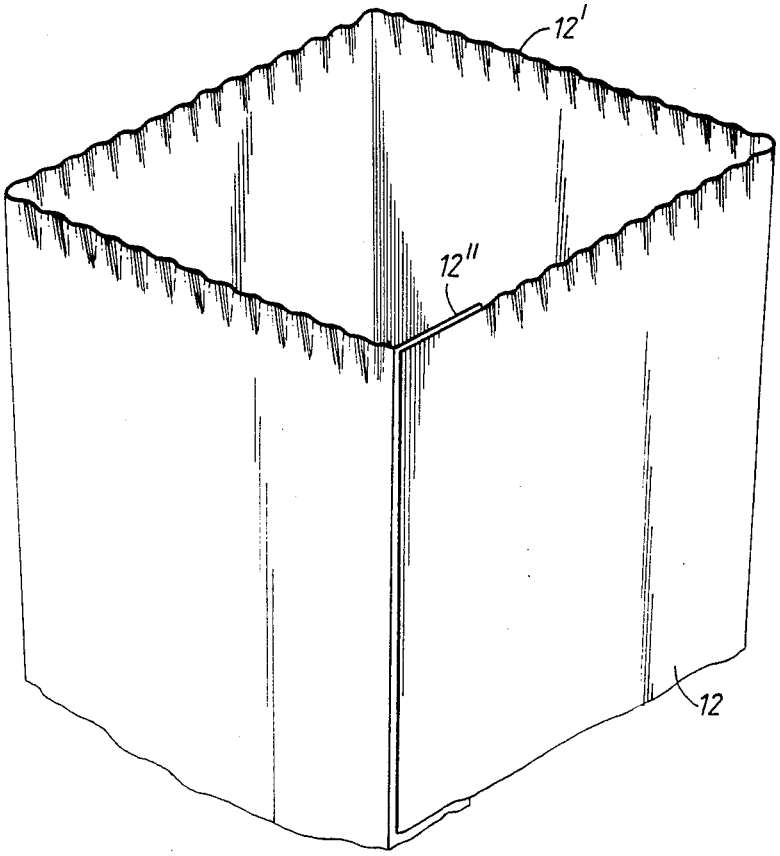
Figure 6:
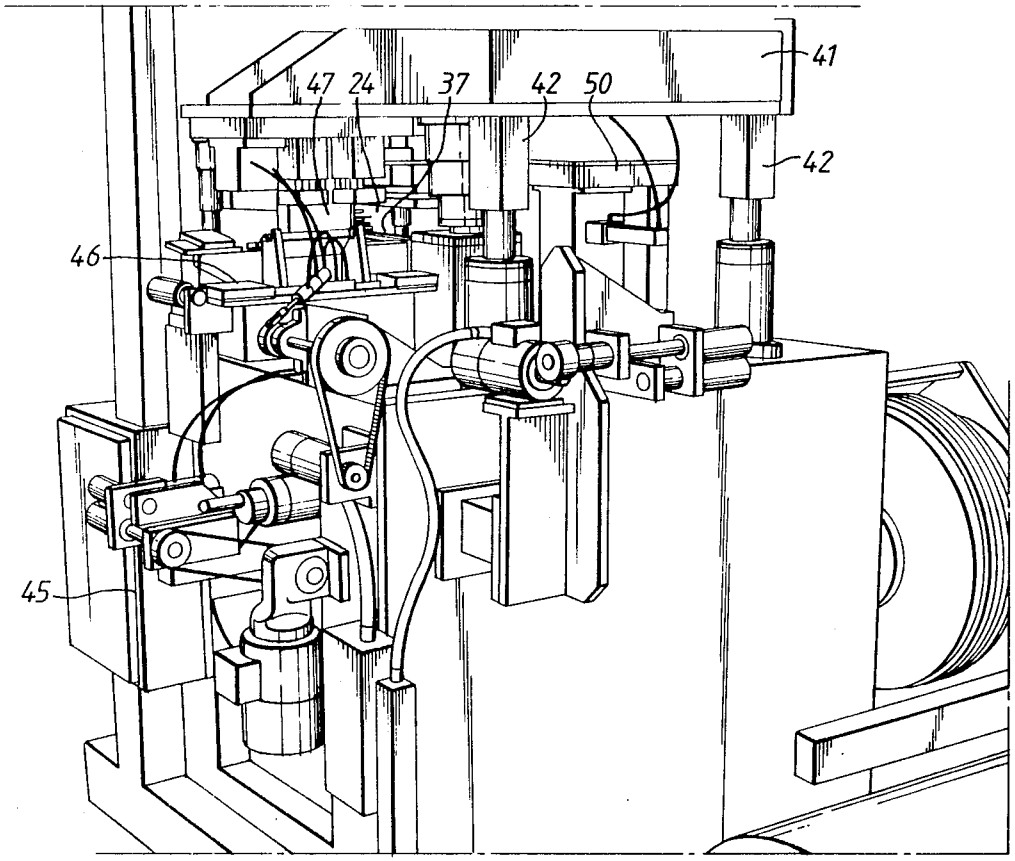
Figure 7:
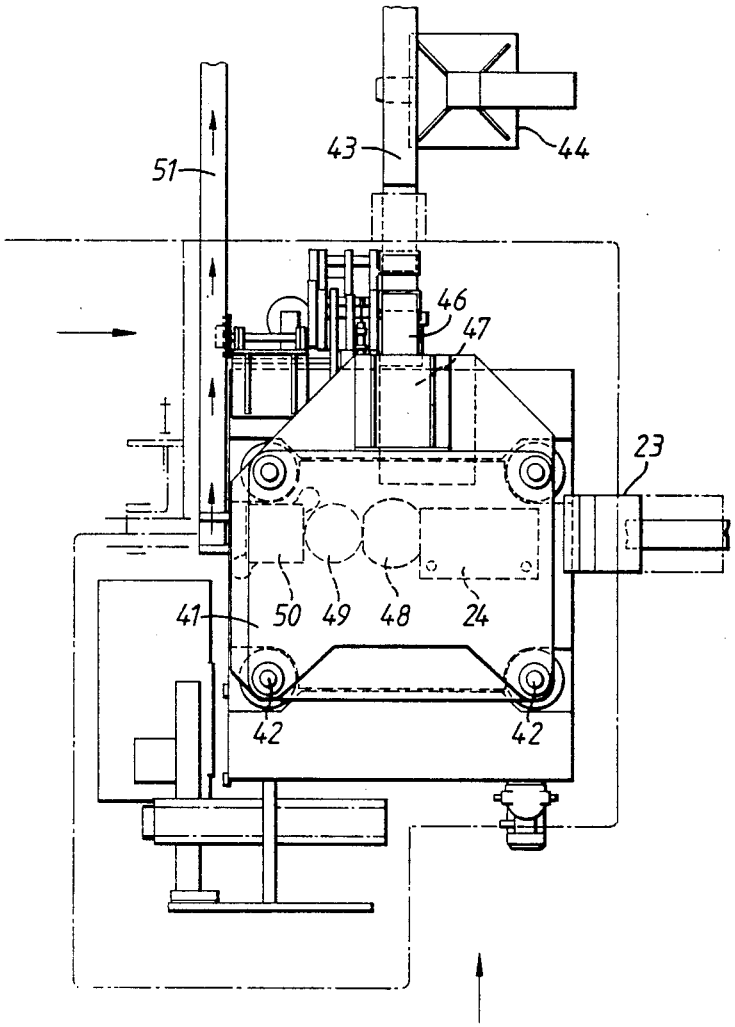
Figure 8:
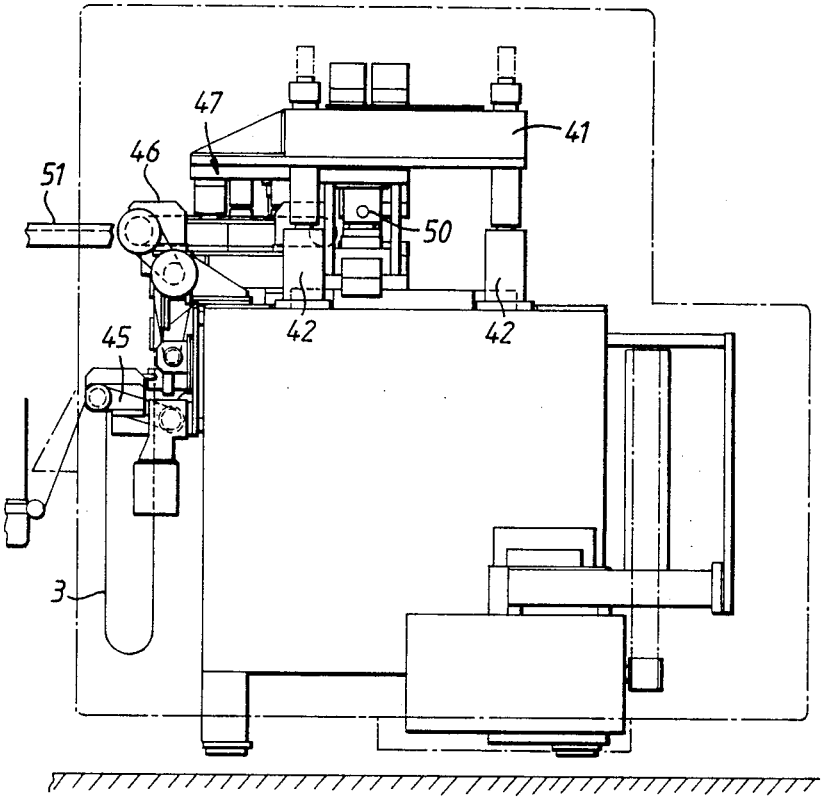
Figure 9:
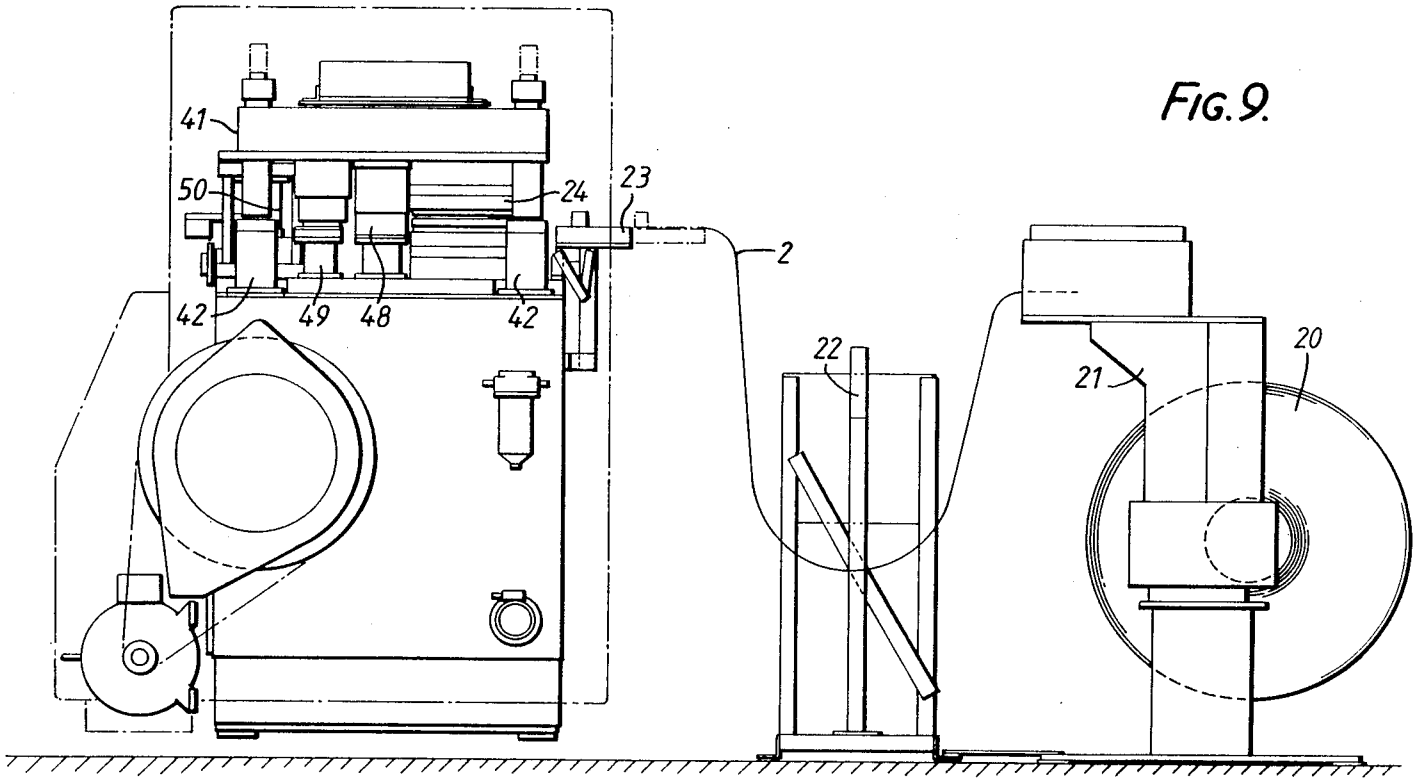
Figure 10:
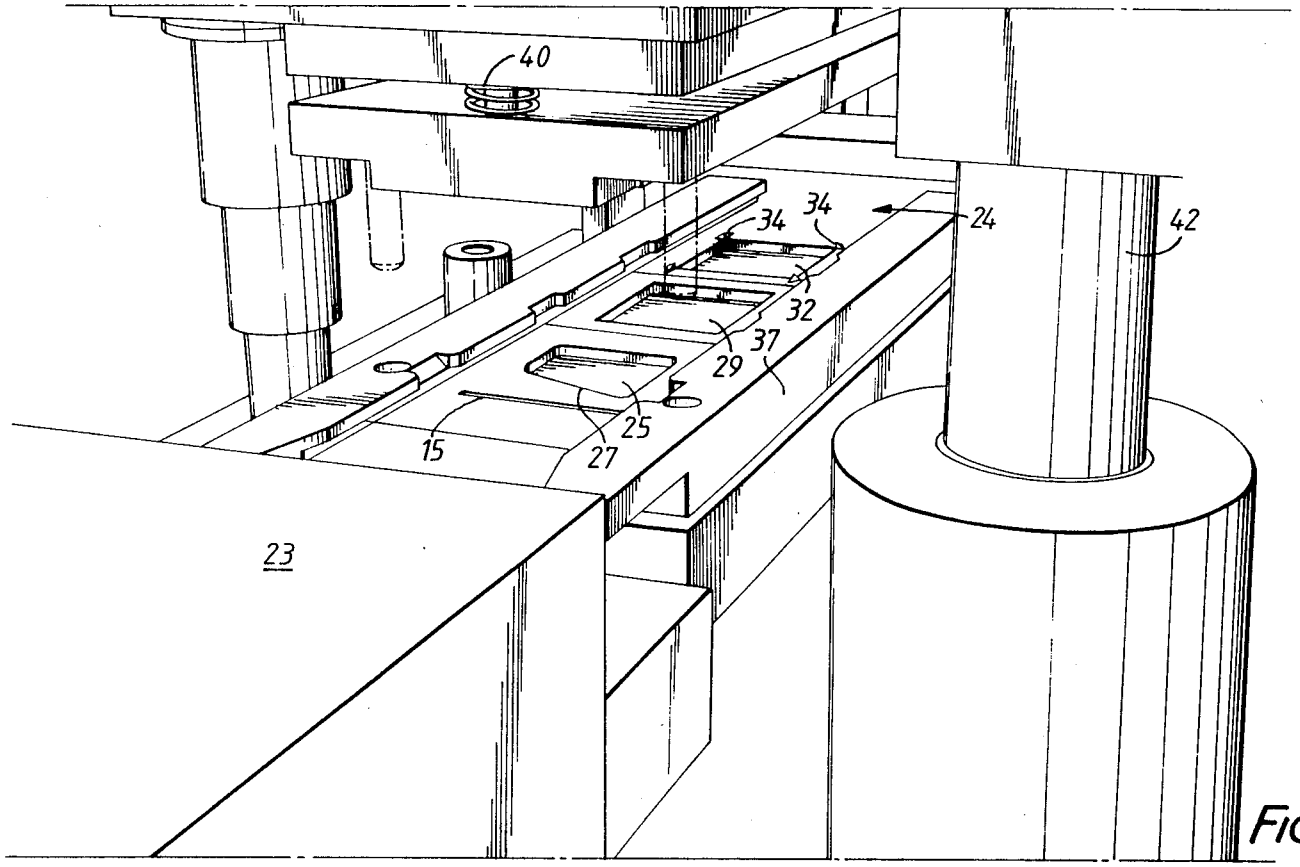
Figure 11:
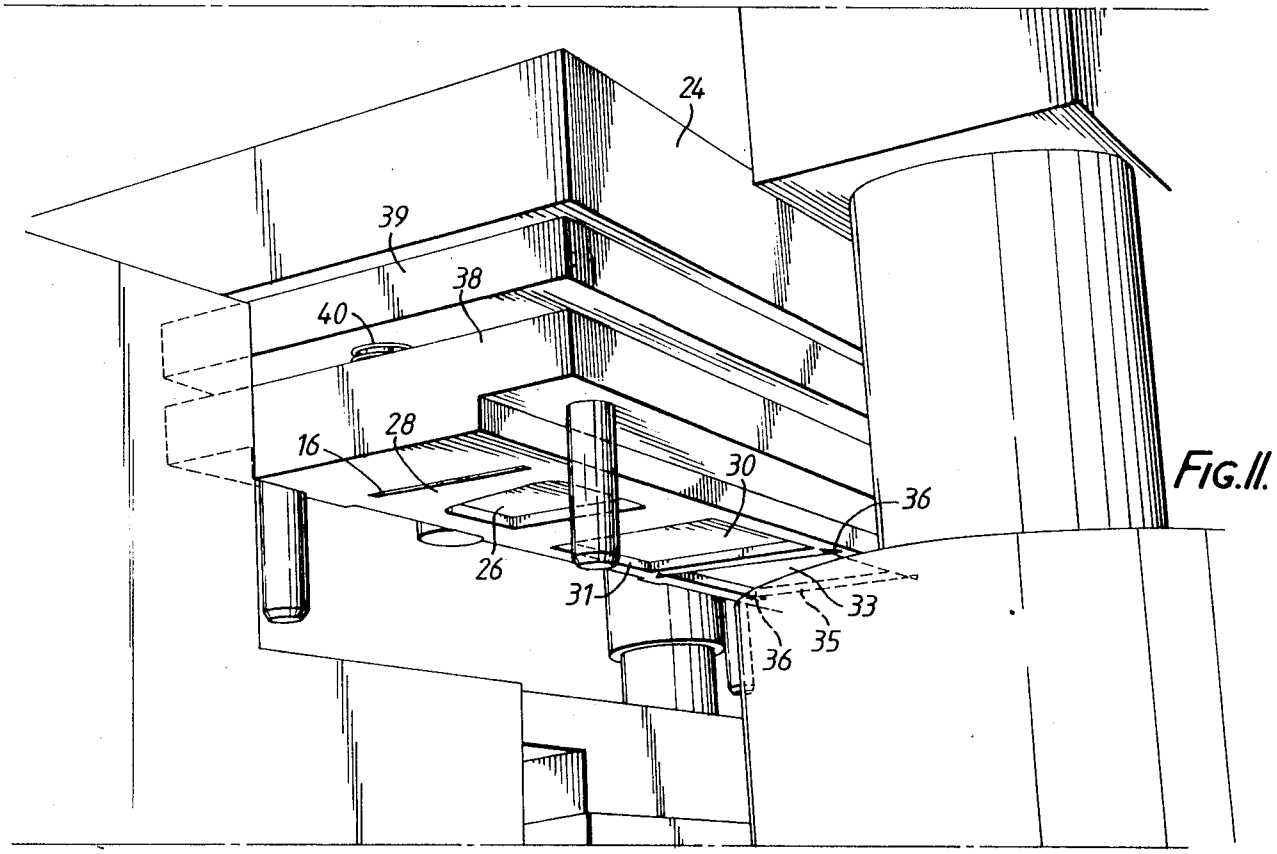
Figure 12:
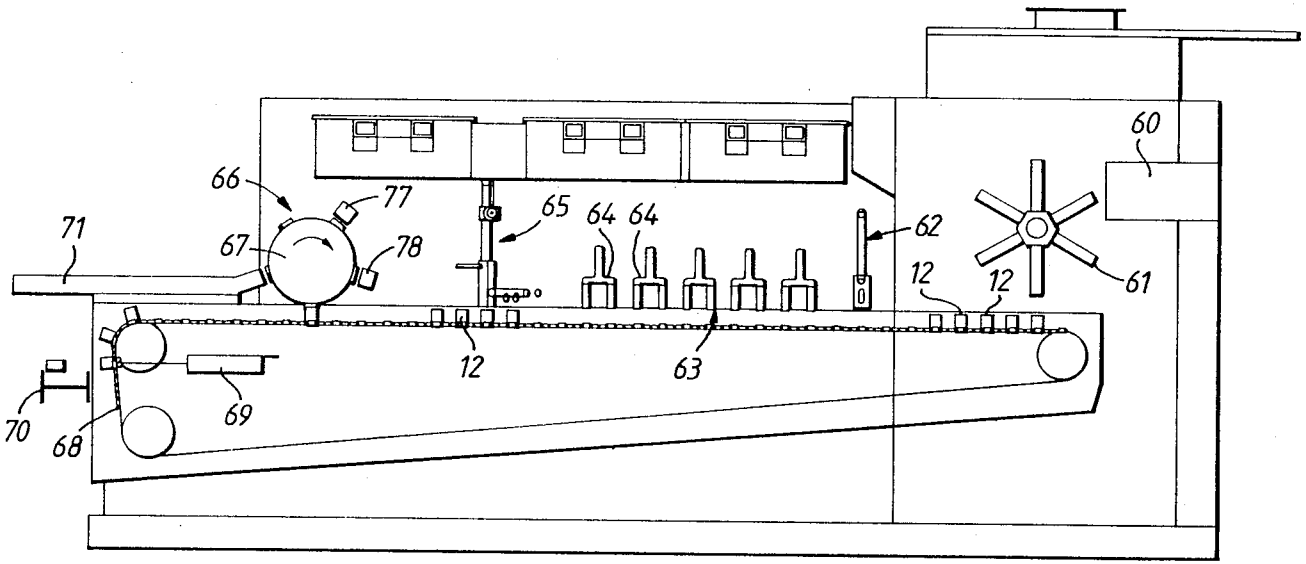
Figure 13:
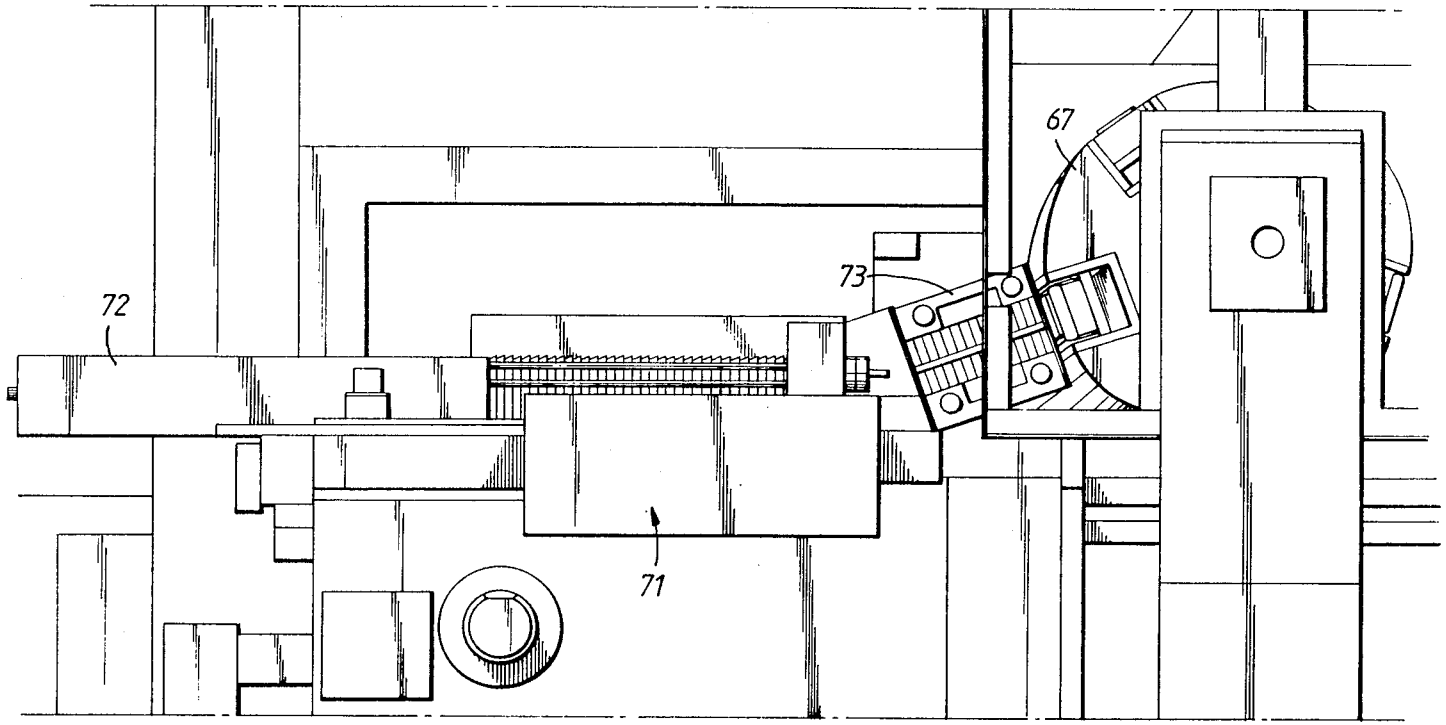
Figure 14:
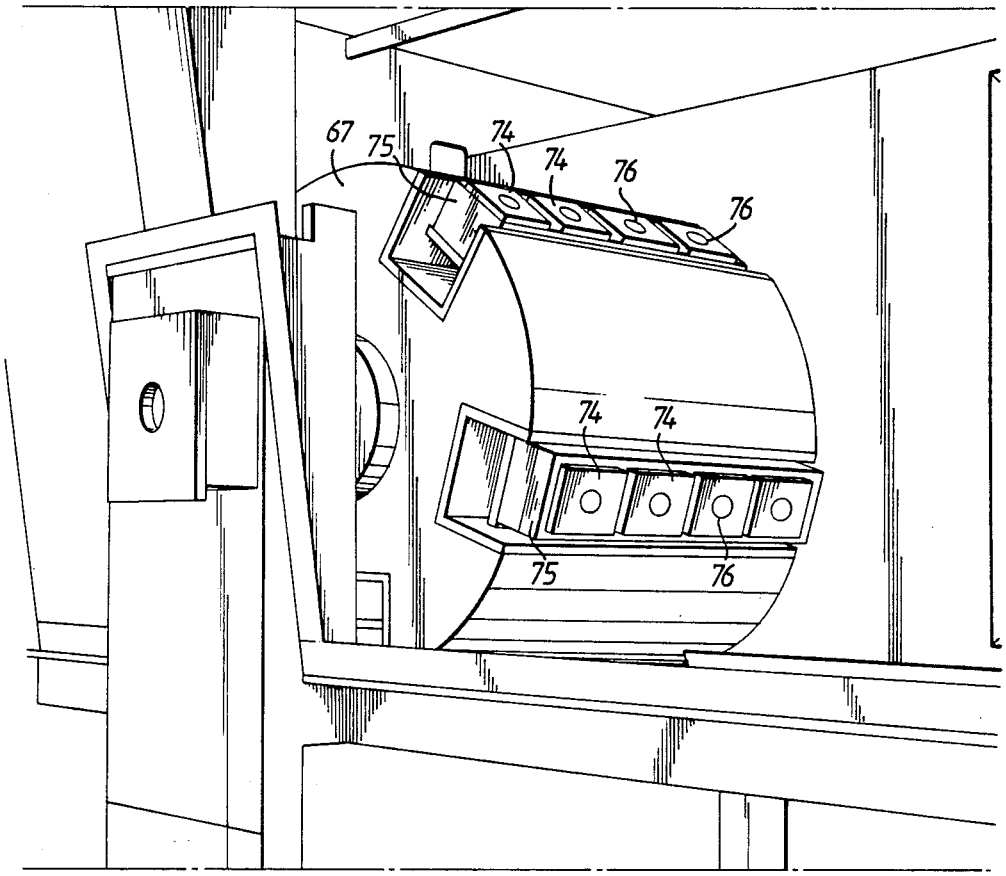
Figure 15:
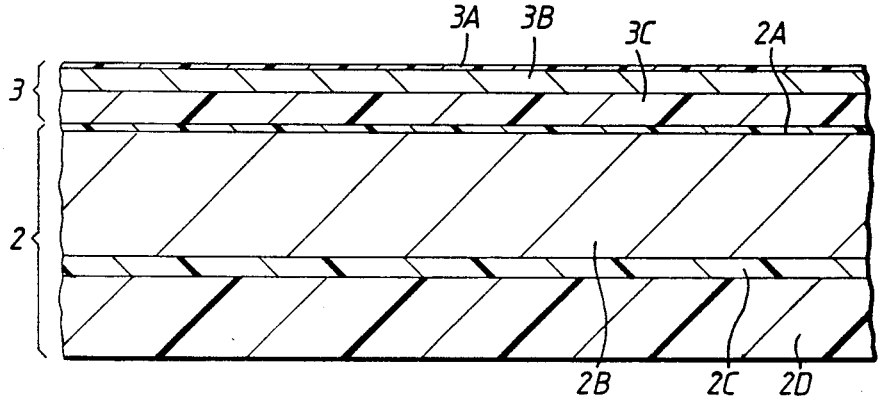

In order that the invention may be clearly understood and readily carried into effect, reference will now be made, by way of example, to the accompanying drawings, in which:

FIG. 1 shows a diagrammatic perspective view of apparatus forming closures of containers from sheet material, FIG. 2 shows a plan view of the forming or closures from sheet material by a modified version of the apparatus, FIG. 3 shows a perspective view of one of the closures prior to heat-sealing to a container, FIG. 4 shows a perspective view of the container with its closure being opened, FIG. 5 shows a modified version of the container, FIG. 6 shows a perspective view of a machine for manufacturing the closures and constituting the modified version of the apparatus, FIG. 7 shows a plan view of the machine shown in FIG. 6, FIG. 8 shows an elevation of the machine taken in the direction of the arrow VIII in FIG. 7, FIG. 9 shows an elevation of the machine taken in the direction of the arrow IX in FIG. 7, FIG. 10 shows a perspective view from above of a piercing and forming device of the machine, FIG. 11 shows a perspective view from below of the piercing and forming device, FIG. 12 shows a diagrammatic side elevation of an aseptic packaging machine in which the closures are applied to the containers, FIG. 13 shows a fragmentary side elevation of a closure feeding device and a closure-applying device included in the machine shown in FIG. 12, FIG. 14 shows a perspective view of the closure-applying device, and FIG. 15 shows a fragmentory vertical section through an embodiment of the closure.

The system to be described with reference to the drawings is for packaging various substances, in particular foodstuffs, in closed containers of rectangular horizontal section. In the system, an open-topped container 12 is sterilized, then filled with the substance, and then has its open top closed with a sterilized closure 1.

The container 12 has been formed from sheet material consisting of paperboard coated on both faces with thermoplastics, for example polyethylene. By cutting and scoring the sheet material, a blank consisting of four main panels and a narrow seam panel has been formed, then the blank has been folded and heat-sealed to produce a rectangular-section sleeve formed with a seam along one corner, and then the sleeve has been bottom-closed by folding inwards and heat-sealing bottom closure sub-panels of the sleeve.

The top closure 1 is formed from a sheet material 2 consisting of a metal/thermoplastics laminate, and a sheet material 3 consisting of metal with adhesive on one face and lacquer or varnish on the other face. The laminate is, for example, a thermally stable lacquer or varnish, e.g. an epoxy resin, and, below, aluminum 200 microns thick and, below, polymer, e.g. a low density polyethylene, 200 microns thick. In an alternative version shown in FIG. 15, the sheet material 2 consists of a lacquer (or polymer)/metal/thermoplastics laminate and the sheet material 3 consists of metal, for example aluminium, with thermoplastic (for example polypropylene) on one face and lacquer or varnish on the other face. The material 2 consists of a lacquer (or polymer) layer 2A which is between 5 and 10 microns thick, a 200-micron aluminium layer 2B, a 30-micron unpigmented EAA (ethylene acrylic acid polymer) layer 2C, and a 130-micron grey-pigmented LLDPE (linear low-density polyethylene) layer 2D, the grey pigment being absorptive of infrared radiation. The material 3 consists of a 5-micron lacquer 3A, a 40-micron aluminium layer 3B and a 50-micron polypropylene layer 3C. In this alternative version, the lacquer (or polymer) 2A and the thermoplastics 3C are so chosen as to heat-seal together in a peelable manner. In forming the closure, as illustrated in FIG. 1, the laminate is sheared around an open loop 4 to provide a flap 5. Then there is adhered to the laminate so as to overlap the loop 4 at all of its four sides, but adhered only locally to the centre of the flap, 5, a diaphragm 7 severed from the material 3. The diaphragm incorporates a pull tab 8. This diaphragm 7 with its pull tab 8 has been formed by folding-back twice upon itself a single edge zone 9 of the material 3 to form the pull tab 8. This double fold provides a stronger pull tab with less possibility of tearing. Then the intended edges of the closure are clamped between two rectangular rings (not shown) encircling the diaphragm 7 at a spacing therefrom, and the zone encircled by the rings is drawn downwards and also outwards from the centre, in order to obtain sharp corners and to avoid wrinkling, a gap 6 being created thereby. The flap 5 is retained for three reasons, namely to give mechanical strength to the closure, also to provide a relatively rigid wall which is easier to sterilize than a thin diaphragm and to reduce litter compared to a case where the flap is readily completely detachable at opening of the container. Then the closure 1 is cut out from the laminate 2, with the edges of the closure being in the form of horizontal flanges 10 and the corners of the closure being in the form of 90° notches 11.

The version shown in FIG. 2, which is in fact the preferred version, differs from that shown in FIG. 1 in that the diaphragm 7 is applied to the flap and its surround after drawing instead of before drawing. It also differs in that among the loops 4 and the drawn-down zones are transverse rectangular slots 14. These slots additionally to the loops 4, facilitate drawing of the material 2 without splitting, in spite of the sharp corners of the rectangular shape of each drawn-down zone, which promote good sealing of the closure to the container.

To attach the closure 1 thus formed to a filled container 12, the closure is placed, lacquer - or varnish-face first, upon the end of a chilled mandrel and is heated from underneath over its whole underneath surface to above the melting point of the plastics to sterilize the underneath surface of the closure and to provide sufficient superheating of the closure to give sufficient stored heat to enable the closure to bond sealingly to the container on application to the container. The drawn-down zone is fitted into the rectangular mouth of the container, and the four flanges 10 are folded down the outside of the rim of the mouth, the molten plastics of the closure reflowing the polyethylene coating of the container and thus forming a good bond therewith, The thickness of the closure plastics is sufficiently great that potential leakage gaps between the closure and the container, particularly at the cut longitudinal edge 12" of the sealing seam panel, are sealed. If the closure plastics is relatively transparent, and the metal is reflective, then, to promote heating of the plastics, the laminate can incorporate material which absorbs infrared radiation, so that the laminate may be heated by the infrared radiation. Such material can be in the form of infrared absorbing particles in the plastics. To scatter the infrared radiation in the laminate the plastics layer may also include infrared reflecting particles to reflect the radiation.

To open the container, the pull tab 8 is seized between the thumb and fore-finger and pulled. Because the adjacent outer edge of the gap 6 is oblique to the adjacent side of the rim of the mouth, the detaching of the diaphragm 7 starts at the acute-angled end of that edge and progresses to the oblique-angled end of that edge. Because the diaphragm 7 is adhered to the flap 5, the flap is pulled back with the diaphragm. Moreover, since the flap is attached to the surround of the opening so produced, the diaphragm 7 and the flap 5 cannot be thrown away separately from the container, so reducing litter. The acute-angled corner of the opening so produced provides a pouring corner for the substance in the container.

Although in this preferred version of the closure, the flap 5 remains attached to the remainder of the closure, in an alternative version, the flap 5 is completely severed instead of being partially severed and is completely removed prior to attaching of the diaphragm 7 to the surround of the opening.

Referring to FIG. 5, in order to allow for significant tolerances during manufacture of the closure and the container and yet ensure a firm seal, the container rim 12' may be of wavy form as shown, so presenting vertical ribs and grooves internally and externally of the rim. For this reason, and again for the reason of the presence of the edge 12", the laminated closure 1 again has a relatively thick layer (about 200 microns) of polyethylene.

Referring to FIGS. 6 to 11, in this machine, the material 2 is fed from a reel 20 on a feed stand 21 and through a loop control stand 22 and a stepping feed device 23 to a piercing and forming device 24 for the material 2. The material 2 approaches the device 24 with its relatively thick polymer layer lowermost. The first step is the piercing of the material 2 to form the slot 14 and at 4 to form the flap 5. For this purpose, the device 24 includes a first set of dies of which the female die 15 is a vertical transverse slot and of which the male die is a rectangular vertical plate-form punch guided in a vertical slot 16, and a second set of dies 25, 26, of which the female die 25 is horizontally arranged and has an appropriately shaped sharp edge 27. The male die 26 is also appropriately shaped, with a sharp edge around most of its circumference, and is vertically reciprocable in an appropriately shaped hollow, vertical guide 28. The next set of dies 29 and 30 forms the drawn-down zone which is to receive the diaphragm 7. The female die 29 is of a rectangular dish shape for this purpose, whilst the male die 30 of rectangular cross-section is vertically reciprocable in a rectangular guide 31. The next set of dies consists of a female die 32 and a male die 33. The female die 32 is similar to the die 29 except that it has sharper internal corners and also carries pointed triangular teeth 34 at the respective four corners thereof to form 90° V-shaped incisions whereof the pieces are at the respective corners of the drawn-down zone and whereof the sides are co-linear with respective edges of the drawn-down zone. The male die 33 is similarly sharp-cornered and is vertically reciprocable in a rectangular guide 35 formed with recesses 36 for receiving the respective teeth 34. The female dies 15, 25, 29 and 32 are releasably fixed in a fixed lower bed 37. The guides are fixedly mounted in an upper bed 38, whilst the male dies are fixedly attached to a top bed 39 which is vertically reciprocable. The bed 38 is resiliently mounted beneath the bed 39 by means of springs 40. The bed 39 is fixed to a press head 41 vertically reciprocable upon pillars 42.

The sheet material 3 is supplied from a reel 43 mounted upon a feed stand 44 and passes through a loop control device 45 to a stepping feed device 46 and a forming and folding device 47 which initially forms, by cutting, a laterally extending tab and then folds the tab over in two stages to form the pull tab 8 folded upon itself. The material 3 is now fed horizontally, perpendicularly to the material 2, to lie just above the material 2 in a cutting and tacking device 48, where the diaphragm 7 is cut from the material 3, inserted into the drawn-down dished zone of the material 2 and heat-tacked to the material 2 to retain the diaphragm in position on the material 2 as the latter advances from the device to the next operational stage. This is carried out with heated dies in a heat-sealing device 49, where the diaphragm is heat-sealed over substantially all of its underneath surface to the base of the dished zone of the material 2. Next, the material 2 advances stepwise from the device 49 to a cropping device 50 where the closure is cut from the material 2 and whence it is carried by a conveyor 51 to be packed into boxes for forwarding to the user of the machine shown in FIGS. 12 to 14. Substantially all of the moving parts of the devices 47, 48, 49 and 50 are fixed to the frame 41.

Referring to FIGS. 12 to 14, the aseptic packaging machine comprises a conventional apparatus 60 for feeding to a rotary, stepping mandrel device 61 seamed carton sleeves each formed from sheet material consisting of paperboard coated on both faces with a suitable thermoplastics material After being bottom-closed on the mandrel device 61 by heat-sealing in a conventional manner, the open-topped cartons 12 so formed are conveyed stepwise through a number of stations by a stepping conveyor 68. The first station is a sterilizing station 62 at which hydrogen peroxide solution is sprayed into the cartons 12. The next station is a drying station 63 at which a series of manifolds 64 feed hot air into the interiors of the cartons 12 to evaporate the hydrogen peroxide solution The next station is a filling station 65 at which the cartons 12 are filled with the substance to be packed, which may be foodstuffs, for example solids mixed in a liquid. Next is a lidding station 66 at which a stepping drum 67 rotating about its horizontal axis applies the closures to the cartons as the latter are advanced stepwise beneath the drum by the conveyor 68. The lidded cartons 12 now advance with the conveyor 68 until they are transferred therefrom by a transfer device 69 onto a conveyor 70. The closures 1 are supplied to the drum 67 by a storage and feed device 71. The closures 1 are unloaded from the boxes into a storage section 72 of the device 71 and from there are fed by a feed section 73 to the rotary drum 67. The drum 67 is rotatable about a horizontal axis and carries, distributed about is peripheral surface, horizontal rows of rectangular, chilled plunger-form mandrels 74 mounted in rectangular guide sleeves 75. Arranged centrally on each mandrel 74 is a suction cup 76. The device 73 presents a plurality of closures, in this case four closures, simultaneously to the respective mandrels 74 with correct position and orientation. Suction is applied to the cups 76 to pull the closures onto the mandrels and hold them there. The closures have their relatively thick polymer layers radially outermost with respect to the axis of the drum 67. As the closures in a row are carried stepwise around the axis of the drum, they arrive at a first infrared heater 77 which heats up the polymer towards the melting temperature of the polymer, and then they are advanced stepwise as a row to a second infrared heater 78 which heats up the polymer to just above its melting temperature. At the next step, the mandrels 74 are advanced radially outwards to apply the closures vertically downwards upon the row of four cartons 12 directly beneath the drum 67 and then the framework 75 associated with that row of mandrels 74 is lowered vertically downwards to fold the flanges 10 down the outside of the rims of the mouths of the carton 12. Then the suction effect of the cups 76 is ceased to allow the lidded carton to be advanced away from the station 66 by the conveyor 68.

Advantages of the system hereinbefore described with reference to the drawings are that the closures produced are sharp-cornered and thus fit well in rectangular containers, and can be of attractive appearance and yet peelingly opened, and that less litter is produced on consumption.

We claim:

1. A method comprising forming a dish-like article (1) from thin sheet material (2) extending in a general plane, said forming comprising clamping the sheet material (2) between two ring means (29,31) and drawing the encircled sheet material (2) to one side of said general plane of the sheet material (2), characterized in that said method includes, prior to said drawing, partially severing a portion (5) of said sheet material (2) from the remainder thereof along substantially a line of severance (4) in the form of an open loop, said ring means (29,31) encircling and being spaced outwardly from said line of severance (4), and said drawing serving to displace said line of severance (4) to said one side.

2. A method according to claim 1, wherein said clamping takes place after the partial severing

3. A method according to claim 1, wherein said sheet material (2) is a laminate including a thermoplastic substance (2D), and wherein said dish-like article (1) is a closure, (1) for a container (12) having a mouth an edge of which has internally a discontinuity (12', 12'') and is applied to said container (12) with said thermoplastic substance (2D) innermost, said substance (2D) coming face-to-face with said discontinuity (12', 12''), and said closure (1) is heat-sealed to said container (12), with said substance (2D) filling said discontinuity (12', 12'').

4. A method according to claim 3, wherein the heat-sealing of said closure (1) to said container (12) includes infrared heating of said thermoplastic substance (2D), said substance (2D) including material which is relatively absorptive of infrared radiation.

5. A method according to claim 4, wherein said substance (2D) includes an additional material which is relatively reflective of infrared radiation.

6. A method according to claim 1, and further comprising attaching a diaphragm (7) to said portion (5) and sealingly but peelably attaching said diaphragm (7) around its periphery to said remainder.

7. A method according to claim 1, wherein said sheet material (2) comprises a thermoplastic first layer (2C, 2D) applied to a second layer (2B) of a material of a higher melting point than the material of the first layer (2C, 2D), and wherein said article (1) is a closure (1) for a container (12) with a mouth rim portion of a thermoplastic material of a melting point lower than that of said second layer (2B), said method further comprising heating said first layer (2C, 2D) from a side thereof opposite to said second layer (2B) to a temperature above the melting point of said first layer (2C, 2D) and the melting point of said mouth rim portion, and applying said closure (1) to said container (12), with said first layer (2C, 2D) being applied to said mouth rim portion and melting the same to produce a bond between said first layer (2C, 2D) and said mouth rim portion upon cooling thereof.

8. A method according to claim 7, wherein said first layer (2C, 2D) and said mouth rim portion are of the same thermoplastic material as each other.

9. A method according to claim 1, wherein said sheet material (2) is a laminate comprising a thermoplastic first layer (2C, 2D) applied to said one side of a second layer (2B) of material of a higher melting point than the material of the first layer (2C, 2D), the thickness of the first layer (2C, 2D) being of the order of 200 microns and roughly equal to the thickness of the second layer (2B).

10. A dish-like article which is of sheet material (2), wherein a base of the article (1) includes a portion (5) partially severed from the remainder of the article (1) along substantially a line of severance (4) in the form of an open loop, and wherein said sheet material (2) comprises a laminate (2) comprising a layer (2B) relatively reflective of infrared radiation and, on the latter layer, an external layer (2C, 2D) comprised of relatively transparent thermoplastic substance (2D) which is to be heated by said infrared radiation, said laminate (2) incorporating material which is relatively absorptive of said infrared radiation.

11. An article according to claim 10, wherein said thermoplastic substance (2D) includes an additional material which is relatively reflective of said infrared radiation.

12. In combination, a container (12) and a dish-like article (1) which is of sheet material (2), characterized in that a base of the article (1) includes a portion (5) partially severed from the remainder of the article (1) along substantially a line of severance (4) in the form of an open loop, said article constituting a closure (1) for said container (12), the container (12) having a mouth an edge of which has internally a discontinuity (12', 12''), and the closure (1) comprising a laminate sheet material (2) including a layer of a thermoplastic substance (2D) arranged to come face-to-face with said discontinuity (12', 12''), characterized in that said layer of a thermoplastic substance (2D) is of sufficient thickness to fill said discontinuity (12', 12'') during heat-sealing of said closure (1) to said container (12).

13. A combination according to claim 12, wherein said discontinuity is a groove (12'') bounded by a cut longitudinal edge of a seam panel at a corner of said container (12).

14. A combination according to claim 12, wherein said discontinuity is a groove (12') between ribs of the edge of the container mouth which ribs extend transversely of that edge.

15. A container and a closure therefor, the container (12) having a mouth the edge of which has internally a discontinuity (12', 12''), and the closure (1) comprising a laminate sheet material (2) including an innermost layer (2C,2D) of a thermoplastic substance (2D) arranged to come face-to-face with said discontinuity (12',12''), characterised in that said thermoplastic substance (2D) is of sufficient thickness to fill said discontinuity (12', 12'') during heat-sealing of said closure (1) to said container (12).

16. A laminate comprising a relatively reflective layer (2B) and, on the latter, an external layer (2C, 2D) comprised of a relatively transparent thermoplastic substance (2D) which is to be heated by infrared radiation, characterised in that said laminate (2) incorporates material which is relatively absorptive of said infrared radiation.

17. A method of applying a closure (1) to a container (12), comprising providing a closure (1) comprised of a thermoplastic first layer (2C, 2D) having an external surface and also having an internal surface applied to a second layer (2B) of a material of a higher melting point than the material of the first layer (2C, 2D) providing a container (12) with a mouth rim portion of a thermoplastic material of a melting point lower than that of said second layer (2B), heating said first layer (2C, 2D) from that side thereof opposite said second layer (2B) to a temperature above the melting point of said first layer (2C, 2D) and the melting point of said mouth rim portion, so as to sterilize said external surface of said first layer (2C, 2D), and applying said closure (1) to said container (12), with said first layer (2C, 2D) being applied to said mouth rim portion and melting the same to produce a bond between said first layer (2C, 2D) and said mouth rim portion upon cooling thereof.

18. A laminate (2) according to claim 21, wherein the relatively reflective layer (2B) is of material of a higher melting point that the material of the external layer (2C, 2D), and the thickness of the external layer (2C, 2D) is of the order of 200 microns and roughly equal to the thickness of the relatively reflective layer (2B).

19. Apparatus comprising means (25–36) for forming a dish-like article (1) from thin sheet material (2), said means (25–36) for forming comprising clamping means (29,31) including two ring means (29, 31) for clamping the sheet material (2) between them, and means (29,30) for drawing the sheet material encircled by said ring means (29,31) to one side of the general plane of the sheet material (2), characterised in that said means (25–36) for forming includes means (26,27) for partially severing a portion (5) of said sheet material (2) from the remainder thereof along substantially a line of severance (4) in the form of an open loop, prior to said drawing.

20. Apparatus according to claim 19, wherein said clamping means (29,31) is disposed after said means (26,27) for partial severing.

21. Apparatus according to claim 19, and further comprising means (49) for attaching a diaphragm (7) to said portion (5) and sealingly but peelably attaching said diaphragm (7) around its periphery to said remainder.

22. Apparatus for applying a closure (1) comprised of a thermoplastic first layer (2C, 2D) having an external surface and also having an internal surface applied to a second layer (2B) of a material of a higher melting point then the material of the first layer (2C, 2D), to a container (12) with a mouth rim portion of a thermoplastic material of a melting point lower than that of said second layer (2B), comprising means (77, 78) for heating said first layer (2C, 2D) from that side thereof opposite to said second layer (2B) to a temperature above the melting point of said first layer (2C, 2D) and the melting point of said mouth rim portion, so as to sterilize said external surface, and means (67, 74) for applying said closure (1) to said container (12), with said first layer (2C, 2D) being applied to said mouth rim portion for melting the same to produce a bond between said first layer (2C, 2D) and said mouth rim portion upon cooling thereof.

23. Apparatus according to claim 22, wherein said means (77,78) for heating comprises infrared heating means (77,78).

24. Apparatus according to claim 22, wherein said means (67,74) for applying comprises chilled mandrel means (74).

25. A dish-like article which is of sheet material (2), wherein a base of the article (1) includes a portion (5) partially severed from the remainder of the article (1) along substantially a line of severance (4) in the form of an open loop, and wherein said sheet material (2) comprises a laminate (2) comprising an external, thermoplastic, first layer (2C, 2D) applied to a second layer (2B) of a material of a higher melting point than the material of the first layer (2C, 2D), the thickness of the first layer (2C, 2D) being of the order of 200 microns and roughly equal to the thickness of the second layer (2B).

26. A method comprising forming a dish-like article (1) from thin sheet material (2) extending in a general plane, said forming comprising clamping the sheet material (2) between two ring means (29, 31) and drawing the encircled sheet material (2) to one side of said general plane of the sheet material (2) characterized in that said method includes partially severing a portion (5) of said sheet material (2) from the remainder thereof along substantially a line of severance (4) in the form of an open loop, said ring means (29,31) encircling and being spaced outwardly from said line of severance (4), and said drawing serving to displace said line of severance (4) to said one side.

27. Apparatus comprising means (25–36) for forming a dish-like article (1) from thin sheet material (2), said means (25–36) for forming comprising clamping means (29, 31) including two ring means (29, 31) for clamping the sheet material (2) between them, and means (29, 30) for drawing the sheet material encircled by said ring means (29, 31) to one side of the general plate of the sheet material (2), characterized in that said means (25–36) for forming includes means (26, 27) for partially severing a portion (5) of said sheet material (2) from the remainder thereof along substantially a line of severance (4) in the form of an open loop.

* * * * *